US011285716B2

(12) United States Patent
Park

(10) Patent No.: US 11,285,716 B2
(45) **Date of Patent: *Mar. 29, 2022**

(54) INK JET PRINTING SYSTEM

(71) Applicant: Semes Co., Ltd., Cheonan-si (KR)

(72) Inventor: Taehyun Park, Seongnam-si (KR)

(73) Assignee: Semes Co., Ltd., Cheonan-si (KR)

( * ) Notice: Subject to any disclaimer, the term of this patent is extended or adjusted under 35 U.S.C. 154(b) by 31 days.

This patent is subject to a terminal disclaimer.

(21) Appl. No.: 16/889,980

(22) Filed: Jun. 2, 2020

(65) Prior Publication Data

US 2020/0391505 A1 Dec. 17, 2020

(30) Foreign Application Priority Data

Jun. 11, 2019 (KR) ..... 10-2019-0068423

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586; B41J 2/16526; B41J 2/16508; B41J 2/01; B41J 3/407; B41J 2/04503; B41J 2/04508; B41J 2/0451; B41J 2/04513; B41J 2/04526; B41J 2/04506; B41J 2/04558; B41J 2/12; B41J 2/125; B41J 2/04561
See application file for complete search history.

(56) References Cited

FOREIGN PATENT DOCUMENTS

| | | | |
|---|---|---|---|
| KR | 10-2010-0070931 | A | 6/2010 |
| KR | 10-2017-0004866 | A | 1/2017 |
| KR | 10-2018-0092275 | A | 8/2018 |
| KR | 10-2018-0102489 | A | 9/2018 |

*Primary Examiner* — Kristal Feggins
(74) *Attorney, Agent, or Firm* — Daly Crowley Mofford & Durkee, LLP

(57) ABSTRACT

The ink jet printing system may have a printing section and a maintenance section. The ink jet printing system may include at least one first alignment mark disposed in the printing section along a first direction, an ink jet head for discharging chemical liquid onto a substrate, at least one second alignment mark disposed in the maintenance section along a second direction perpendicular to the first direction, at least one first identification member disposed proximate to the ink jet head, the at least one first identification member identifying the at least one first alignment mark and the at least one second alignment mark, a gantry extended from the printing section to the maintenance section, the gantry moving the ink jet head between the printing section and the maintenance section, at least one second identification member disposed proximate to the gantry, the at least one second identification member identifying discharging points of the chemical liquid in the maintenance section, and a control member for correcting discharging points of the chemical liquid discharged from the ink jet head onto the substrate in the printing section based on a result that the at least one second identification member identifies the discharging points in the maintenance section.

20 Claims, 3 Drawing Sheets

INK JET PRINTING SYSTEM

CROSS-REFERENCE TO RELATED APPLICATION

This application claims priority to Korean Patent Application No. 10-2019-0068423 filed on Jun. 11, 2019 in the Korean Intellectual Property Office (KIPO), the contents of which are herein incorporated by reference in its entirety.

BACKGROUND

1. Field

Example embodiments of the invention relate to an ink jet printing system. More particularly, example embodiments of the invention relate to an ink jet printing system capable of exactly discharging chemical liquid onto pixel regions of a substrate.

2. Related Technology

Recent display devices such as liquid crystal display devices or organic light emitting display devices demand high resolution. To accomplish such a display device having high resolution, a substrate for manufacturing the display device has more pixel regions per unit area. However, the display device having high resolution cannot be accomplished if chemical liquid is not exactly discharged onto dense pixel regions of the substrate.

SUMMARY

It is an object of the invention to provide an ink jet printing system for exactly discharging chemical liquid onto dense pixel regions of a substrate for a display device having high resolution.

According to one aspect of the invention, there is provided an ink jet printing system having a printing section and a maintenance section. The ink jet printing system may include at least one first alignment mark disposed in the printing section along a first direction; an ink jet head for discharging chemical liquid onto a substrate; at least one second alignment mark disposed in the maintenance section along a second direction substantially perpendicular to the first direction; at least one first identification member disposed proximate to the ink jet head, the at least one first identification member identifying the at least one first alignment mark and the at least one second alignment mark; a gantry extended from the printing section to the maintenance section, the gantry moving the ink jet head between the printing section and the maintenance section; at least one second identification member disposed proximate to the gantry, the at least one second identification member identifying discharging points of the chemical liquid in the maintenance section; and a control member for correcting discharging points of the chemical liquid discharged from the ink jet head onto the substrate in the printing section based on a result that the at least one second identification member identifies the discharging points in the maintenance section.

In example embodiments, the printing section may be disposed in the first direction, and the maintenance section may be proximate to the printing section and may be disposed in the second direction.

In example embodiments, the ink jet head may move in the second direction and the gantry may move in the first direction.

In example embodiments, the at least one first identification member may move in the first direction and the second direction.

In example embodiments, the ink jet printing system may include two first identification members and two first alignment marks. In this case, the two first identification members may identify the two first alignment marks as the ink jet head moves in the printing section.

In example embodiments, the ink jet printing system may include two second alignment marks. In this case, the two first identification members may identify the two second alignment marks as the ink jet head moves in the maintenance section.

In example embodiments, the at least one second identification member may move in the second direction.

In example embodiments, the ink jet printing system may additionally include two second identification members. In this case, the two first identification members may identify the two second alignment marks as the gantry moves in the maintenance section.

In example embodiments, the ink jet printing system may additionally include floating stages for floating the substrate and transfer members for transferring the substrate disposed in each of the printing section and the maintenance section, respectively.

In other example embodiments, the ink jet printing system may additionally include an auxiliary gantry disposed in the maintenance section along the second direction. In this case, the at least one second identification member may be disposed proximate to the auxiliary gantry.

According to another aspect of the invention, there is provided an ink jet printing system having a printing section and a maintenance section. The ink jet printing system may include at least one first alignment mark disposed in the printing section along a first direction; an ink jet head for discharging chemical liquid onto a substrate; at least one second alignment mark disposed in the maintenance section along a second direction substantially perpendicular to the first direction; at least one first identification member disposed proximate to the ink jet head, the at least one first identification member identifying the at least one first alignment mark and the at least one second alignment mark; a gantry extended from the printing section to the maintenance section, the gantry moving the ink jet head between the printing section and the maintenance section; at least one second identification member disposed proximate to the gantry, the at least one second identification member identifying discharging points of the chemical liquid in the maintenance section; and a control member controlling a setting of a position of the at least one first identification member for identifying the at least one first alignment mark and the at least one second alignment mark, a setting of a position of the ink jet head based on identifications of the at least one first alignment mark and the at least one second alignment mark, and a setting of a position of the at least one second identification member for identifying the discharging points of the chemical liquid.

In some example embodiments, the ink jet printing system may additionally include two first identification members and two second alignment marks. In this case, the control member may enable the two first identification members to identify one of the two second alignment marks, and one of the two first identification members to identify the two second alignment marks such that the control member may control the setting of the position of the ink jet head relative to the first direction and the second direction.

In example embodiments, the control member may correct discharging points of the chemical liquid discharged from the ink jet head onto the substrate in the printing section based on a result that the at least one second identification member identifies the discharging points in the maintenance section.

In some example embodiments, the ink jet printing system may include two first alignment marks provided on a first substrate transferred in the printing section along the first direction. Further, the ink jet printing system may include two second alignment marks provided on a second substrate transferred in the printing section along the first direction. In this case, the second substrate may include a relatively short side in the first direction and a relatively long side in the second direction.

In some example embodiments, the ink jet printing system may additionally include a member for preventing a spread of the chemical liquid provided on the second substrate.

In other example embodiments, the ink jet printing system may additionally include an auxiliary gantry disposed in the maintenance section along the second direction. In this case, the at least one second identification member may be disposed proximate to the auxiliary gantry.

According to still another aspect of the invention, there is provided an ink jet printing system having a printing section and a maintenance section. The ink jet printing system may include two first alignment marks disposed in the printing section along a first direction; an ink jet head for discharging chemical liquid onto a substrate; two second alignment marks disposed in the maintenance section along a second direction substantially perpendicular to the first direction; two first identification members disposed proximate to the ink jet head, wherein the two first identification members identify the two first alignment marks and the two second alignment marks; a gantry extended from the printing section to the maintenance section, wherein the gantry moves along the first direction and transfers the ink jet head between the printing section and the maintenance section along the second direction; a second identification member disposed proximate to the gantry, wherein the second identification member identifies discharging points of the chemical liquid in the maintenance section; and a control member controlling a setting of a position of the first identification members for identifying the first alignment marks and the second alignment marks, a setting of a position of the ink jet head based on identifications of the first alignment marks and the second alignment marks, and a setting of a position of the second identification member for identifying the discharging points of the chemical liquid, wherein the control member corrects discharging points of the chemical liquid discharged from the ink jet head onto the substrate in the printing section based on a result that the second identification member identifies the discharging points in the maintenance section.

In some example embodiments, the ink jet printing system may additionally include an auxiliary gantry disposed in the maintenance section along the second direction. In this case, the second identification member may be disposed proximate to the auxiliary gantry.

According to example embodiments, the chemical liquid may be exactly discharged onto the substrate after the discharging points of the chemical liquid is corrected based on the discharging points of the chemical liquid identified in the maintenance section. The ink jet printing system may exactly provide the chemical liquid onto dense pixel regions of the substrate such that recent display devices having high resolution may have reliably accomplished.

BRIEF DESCRIPTION OF THE DRAWINGS

Example embodiments will be more clearly understood from the following detailed description taken in conjunction with the accompanying drawing. The following figures represent non-limiting, example embodiments as described herein.

DESCRIPTION OF EMBODIMENTS

Figure 1:
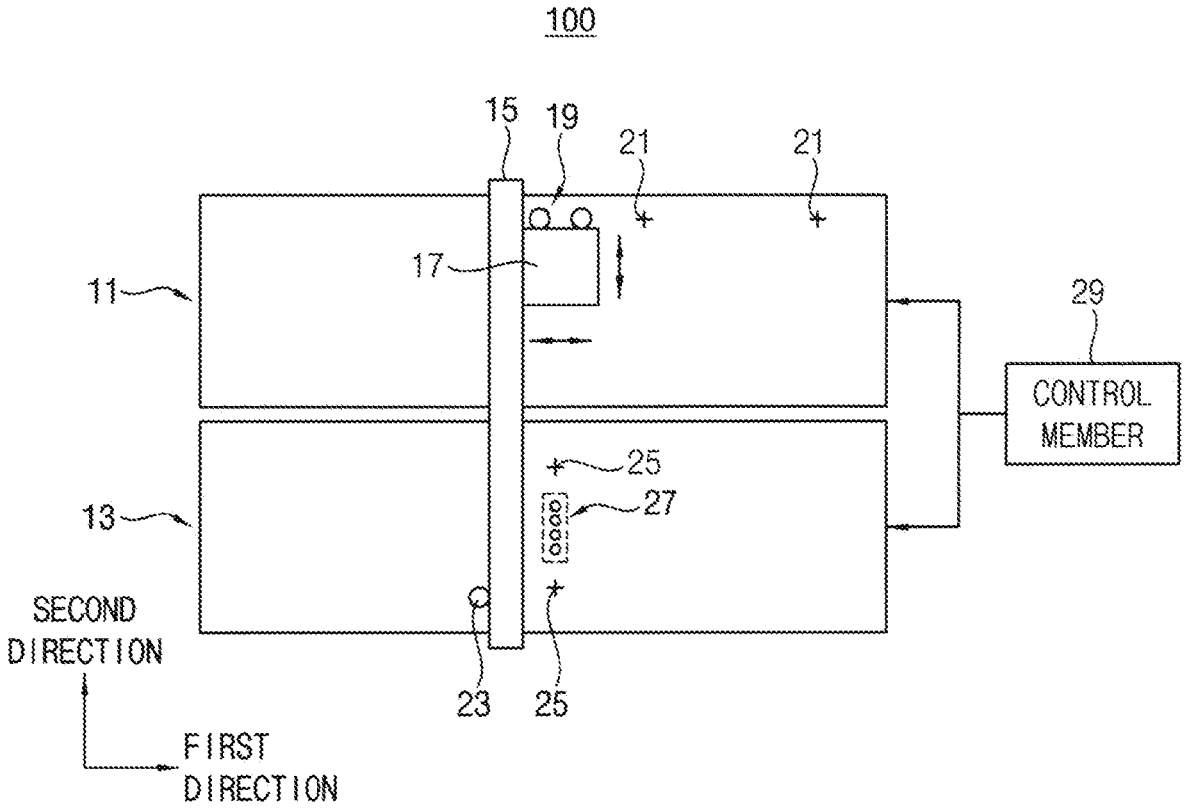
FIG. 1 illustrates a schematic configuration of an ink jet printing system in accordance with example embodiments of the invention.

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, ink jet printing systems according to example embodiments will be described with reference to the accompanying drawings.

FIG. 1 illustrates a schematic configuration of an ink jet printing system in accordance with example embodiments of the invention.

Referring to FIG. 1, an ink jet printing system 100 may include a printing section 11 and a maintenance section 13. Additionally, the ink jet printing system 100 may include a gantry 15, an ink jet head 17, at least one first identification member 19, at least one second identification member 23, a control member 29, etc.

The printing section 11 may be placed along a first direction relative to an object to be treated such as a substrate. In example embodiments, the ink jet head 17 may be disposed in the printing section 11. In the printing section 11, a printing process of discharging chemical liquid onto the substrate from the ink jet head 17 may be performed (hereinafter, the substrate may also be referred to as a first substrate in the printing section 11).

In example embodiments, the ink jet printing system 100 may include at least one first alignment mark 21 positioned in the printing section 11. For example, two first alignment marks 21 may be provided in the printing section 11 along the first direction. In some example embodiments, the ink jet printing system 100 may include a plurality of first alignment marks 21 positioned at one side of the printing section 11 along the first direction. Here, the plurality of first alignment marks 21 may be spaced apart by substantially identical distances. Further, the plurality of first alignment marks 21 may be arranged in a substantial line along the first direction.

The ink jet head 17 may include a plurality of nozzles capable of discharging the chemical liquid onto the substrate. The plurality of nozzles of the ink jet head 17 may be arranged in a substantial line by predetermined intervals. Additionally, the ink jet head 17 may include a plurality of piezoelectric elements wherein the number of the piezoelectric elements may correspond to the number of the nozzles. The chemical liquid may be provided onto the substrate from the nozzles by the operations of the piezoelectric elements. For example, the voltages applied to the piezoelectric elements may be independently controlled such that the discharging points of the chemical liquid supplied onto the substrate from the nozzles may be independently adjusted.

In example embodiments, the substrate may be transferred into the printing section 11 while performing the printing process for discharging the chemical liquid onto the substrate. The substrate transferred into the printing section 11 may float over a stage (not illustrated) which can support the substrate. For example, a floating stage may be disposed in the printing section 11 to float the substrate. Further, a transfer member (not illustrated) may be disposed in the printing section 11. The transfer member may hold one lateral portion or both lateral portions of the substrate and may transfer the substrate over the floating stage. In this case, the transfer member may include a guide rail and a gripper. The guide rail may locate over the one lateral portion or both of the lateral portions of the substrate, and the gripper may move along the guide rail while the gripper holds the one lateral portion or both of the lateral portions of the substrate.

Referring now to FIG. 1, the maintenance section 13 may be adjacent to the printing section 11 and may locate along a second direction. Here, the second direction may be perpendicular to the first direction. The maintenance section 13 may be disposed in parallel to the printing section 11. The ink jet head 17 may be maintained in the maintenance section 13.

In example embodiments, the ink jet printing system 100 may include at least one second alignment mark 25 positioned in the maintenance section 13. For example, the ink jet printing system 100 may include two second alignment marks 21 provided at one side of the maintenance section 13 along the second direction. In some example embodiments, the ink jet printing system 100 may include a plurality of second alignment marks 21 at one side of the maintenance section 13 in the second direction. The plurality of second alignment marks 21 may be separated by substantially identical distances and may be arranged in a substantial line along the second direction. Accordingly, the first alignment mark 21 of the printing section 11 may be substantially perpendicular to the second alignment mark 25 of the maintenance section 13.

In some example embodiments, the discharging points of the chemical liquid discharged onto the substrate may be identified in the maintenance section 13. The maintenance section 13 may also include a floating stage (not illustrated)

capable of floating the substrate and a transfer member (not illustrated) capable of transferring the substrate over the floating stage (hereinafter, the substrate may be referred to as a second substrate in the maintenance section 13).

The gantry 15 may move the ink jet head 17 between the printing section 11 and the maintenance section 13. The gantry 15 may extend from the printing section 11 to the maintenance section 13. For example, the gantry 15 may be disposed across the printing section 11 and the maintenance section 13 along the second direction so that the ink jet head 17 may be linearly moved along the gantry 15 between the printing section 11 and the maintenance section 13. Further, the gantry 15 may move along the first direction. Namely, the gantry 15 may move in the first direction whereas the ink jet head may move along the second direction.

As illustrated in FIG. 1, the printing section 11 may include the at least one first identification member 19 proximate to the ink jet head 17. For example, the at least one first identification member 19 may be fixed to one side of the ink jet head 17. The at least one first identification member 19 may identify the at least one first alignment mark 21, and may include a camera or an imaging device such as a charge-coupled device (CCD). In this case, the at least one first identification member 19 may be aligned with the at least one first alignment mark 21 along the first direction. In some example embodiments, two first identification members 19 may be attached to the side of the ink jet head 17. Such two first identification members 19 may recognize the two first alignment marks 21 if the ink jet head 17 moves along the first direction. In other example embodiments, the printing section 11 may include a plurality of first identification members 19 such that the plurality of first identification members 19 may identify the plurality of first alignment marks 21 as the ink jet head 19 moves in the first direction.

According to example embodiments, the at least one first identification member 19 may move along the first direction while the gantry 15 moves in the first direction. Additionally, the at least one first identification member 19 may move the second direction as the ink jet head 17 moves in the second direction. Therefore, the at least one first identification member 19 may identify the at least one first alignment mark 21 in the printing section 11 and also may recognize the at least one second alignment mark 25 in the maintenance section 13.

The maintenance section 13 may include the at least one second identification member 23 proximate to the gantry 15. The at least one second identification member 23 may include a camera or an imaging device such as a CCD. The at least one second identification member 23 may move in the second direction along the gantry 15. The gantry 15 may move in the first direction and the at least one second identification member 23 may move the second direction, so that the at least one second identification member 23 may identify the discharging points 27 of the chemical liquid discharged from the ink jet head 17 in the maintenance section 13. The discharging points 27 in the maintenance section 13 may be used for the correction of the discharging points of the chemical liquid as described below. For example, the discharging points 27 may arranged in one line or in two lines. Here, the at least one second identification member 23 may recognize the discharging points 27 arranged in one line or in two lines while the at least one second identification member 23 moves in the second direction.

The control member 29 may adjust the discharging points of the chemical liquid discharged from the ink jet head 17 onto the substrate in the printing section 11 based on the result that the at least one second identification member 23 identifies the discharging points 27 in the maintenance section 13. According to example embodiments of the invention, the control member 29 may control the setting of the position of the at least one first identification member 19 for identifying the at least one first alignment mark 21 and the at least one second alignment mark 25, the setting of the position of the ink jet head 17 based on the identifications of the at least one first alignment mark 21 and the at least one second alignment mark 25, and the setting of the position of the at least one second identification member 23 for identifying the discharging points 27.

The control member 29 may control the setting of the position of the at least one first identification member 19 through the identification of the at least one first alignment mark 21. With such setting of the position of the at least one first identification member 19, the control member 29 may identify whether the ink jet head 17 locates at a desired position.

In some example embodiments, the control member 29 may control the setting of the position of the ink jet head 17 in the maintenance section 13. In this case, the ink jet printing system 100 may include two first identification members 19 and two second alignment marks 25. The control member 29 may enable the two first identification members 19 to identify one of the two second alignment marks 25, and thus the control member 29 may control the setting of the position of the ink jet head 17 relative to the first direction. In other words, the control member 29 may adjust a first position of the ink jet head 17 such that the ink jet head 17 may be arranged along the first direction in the maintenance section 13. The first position of the ink jet head 17 may be set by moving the gantry 15 so that the two first identification members 19 may recognize the one of the two second alignment marks 25.

The control member 29 may enable one of the two first identification members 19 to identify the two second alignment marks 25, and thus the control member 29 may control the setting of the position of the ink jet head 17 relative to the second direction. In other words, the control member 29 may adjust a second position of the ink jet head 17 so that the ink jet head 17 may be arranged along the second direction in the maintenance section 13. The second position of the ink jet head 17 may be set by moving the ink jet head 17 such that the one of the two first identification members 19 may recognize the two second alignment marks 25.

The control member 29 may control the ink jet head 17 so that the chemical liquid may be discharged from the ink jet head 17 set at the first position and the second position in the maintenance section 13. Here, the discharging points 27 of the chemical liquid may be arranged by the control member 29 in one line or two lines as described above.

In some example embodiments, the control member 29 may control the at least one second identification member 23 such that the at least one second identification member 23 may identify the discharging points 27 of the chemical liquid discharged in the maintenance section 13. Then, the control member 29 may correct the discharging points of the chemical liquid discharged onto the substrate in the printing section 11 based on the result that the at least one second identification member 23 recognize the discharging points 27. Therefore, the ink jet printing system 100 may exactly discharge the chemical liquid from the ink jet head 17 onto the substrate utilizing the correction of the discharging points of the chemical liquid by the control member 29. As a result, the ink jet printing system 100 may exactly provide the chemical liquid onto dense pixel regions of the substrate for manufacturing a display device having high resolution.

In the ink jet printing system 100 according to example embodiments, the processes of discharging the chemical liquid may be performed in the printing section 11 and the maintenance section 13, the position of the first identification member 19 may be set using the first alignment mark 21, and the position of the ink jet head 17 may be exactly set using the first identification member 19 and the second alignment mark 25. Then, the discharging points of the chemical liquid may be identified in the maintenance section 13, and the discharging points of the chemical liquid discharged onto the pixel regions of the substrate may be exactly corrected in the printing section 11.

Figure 2:
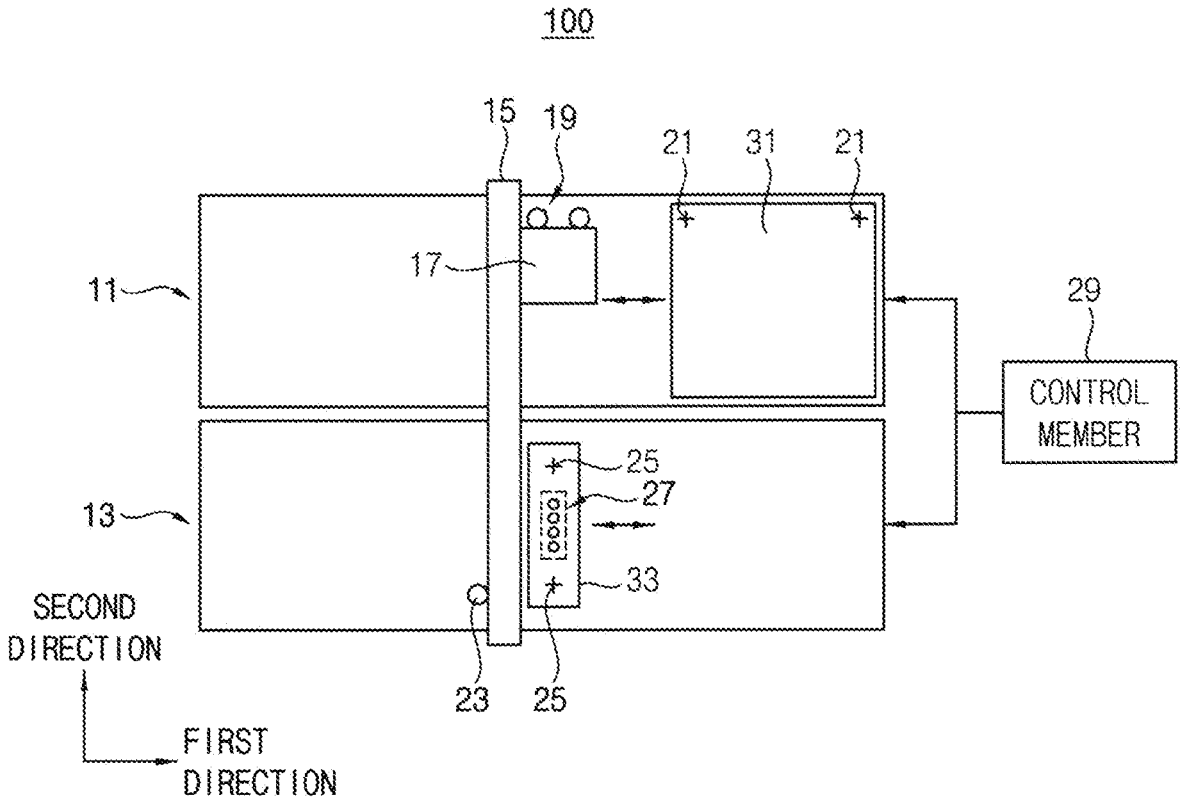
FIG. 2 illustrates a schematic configuration of an ink jet printing system in accordance with some example embodiments of the invention.

FIG. 2 illustrates a schematic configuration of an ink jet printing system in accordance with some example embodiments of the invention. The ink jet printing system 100 illustrated in FIG. 2 may have a configuration similar to that of the ink jet printing system 100 illustrated in FIG. 1 except a first substrate 31 including two first alignment marks 21 and a second substrate 33 including two second alignment marks 25.

Referring to FIG. 2, the two first alignment marks 21 may be provided on the first substrate 31 transferred in the printing section 11. The first substrate 31 may be transferred along the first direction in the printing section 11. The two second alignment marks 25 may be provided on the second substrate 33 transferred in the maintenance section 13. The second substrate 33 may be transferred along the second direction in the maintenance section 13.

In some example embodiments, the second substrate 33 may have a relatively short side portion in the first direction and a relatively long side portion in the second direction. In other words, the second substrate 33 may have a size on which the chemical liquid can be discharged onto the second substrate 33 with the discharging points 27 in a line or two lines. For example, the second substrate 33 may have a rectangular plate shape.

In other example embodiments, a member for preventing the spread of the chemical liquid may be provided on the second substrate 31 in order to exactly indentify the discharging points 27 of the chemical liquid. For example, the member for preventing the spread of the chemical liquid may include a film composed of an organic material.

In the ink jet printing system 100 illustrated in FIG. 2, it may be identified the two first alignment marks 21 provided on the first substrate 31 which is transferred in the first direction in the printing section 11. Thus, when the at least one first identification member 19 and the two first alignment marks 21 are arranged in a line, the gantry 15 may maintain a state where the gantry 15 is fixed in the ink jet printing system 100. In addition, it may be identified the two second alignment marks 25 provided on the second substrate 33 which is transferred in the first direction in the maintenance section 13, and thus the gantry 15 may maintain the state where the gantry 15 is fixed in the ink jet printing system 100 when the at least one first identification member 19 and the two second alignment marks 21 are arranged in a line.

Additionally, the control member 29 may correct the discharging points of the chemical liquid provided onto the first substrate 31 in the printing section 11 based on the identifications of the two first alignment marks 21 and the two second alignment marks 25 and the identification of the discharging points 27 of the chemical liquid discharged onto the second substrate 33. After the correction of the discharging points of the chemical liquid is performed, the chemical liquid may be discharged onto the first substrate 31 in the printing section 11. As a result, the ink jet printing system 100 may exactly provide the chemical liquid onto the dense pixel regions of the first substrate 31 for manufacturing a display device having high resolution.

Those ordinary skilled in the art can select the configuration in which the two first alignment marks 21 are provided in the printing section 11 or on the first substrate 31, or the configuration in which the two second alignment marks 25 are provided in the maintenance section 13 or on the second substrate 33 as occasion demands.

Figure 3:
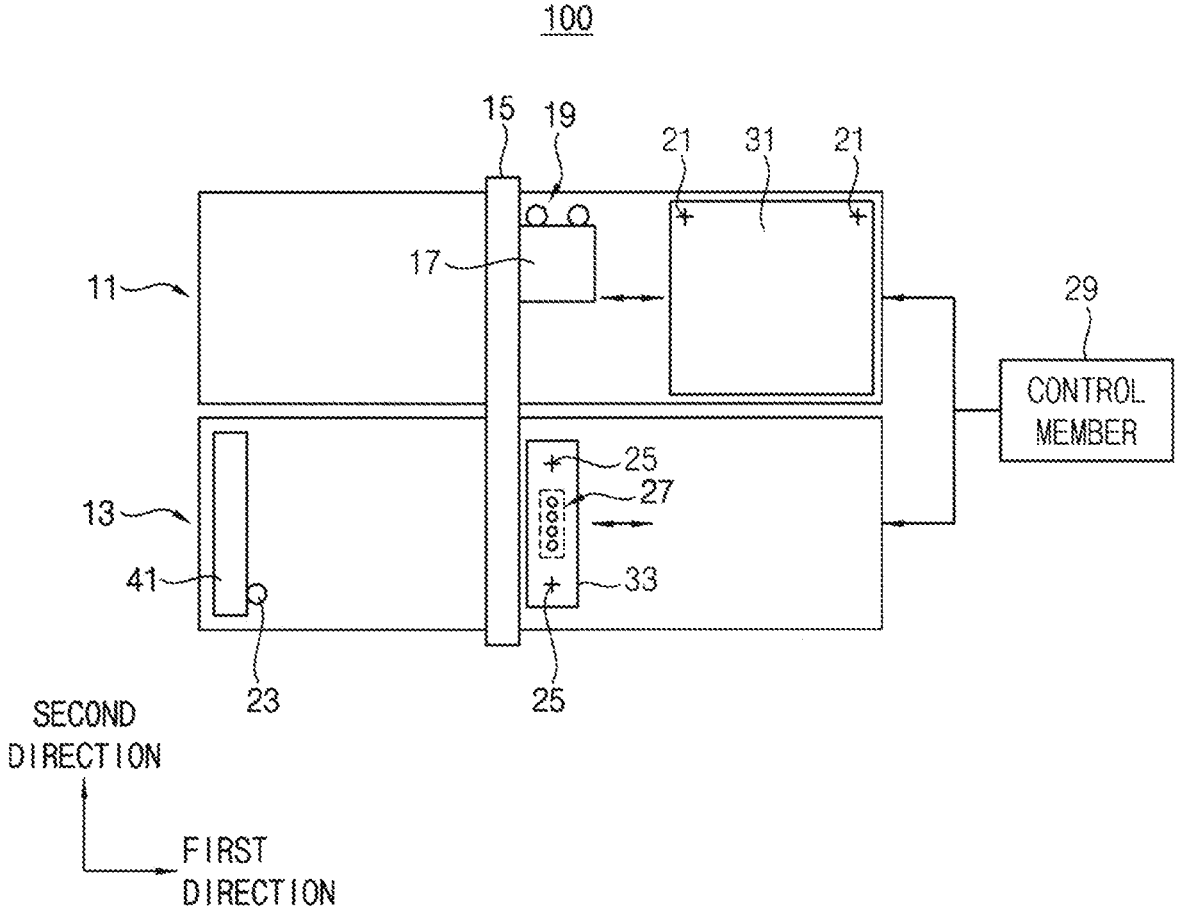
FIG. 3 illustrates a schematic configuration of an ink jet printing system in accordance with other example embodiments of the invention.

FIG. 3 illustrates a schematic configuration of an ink jet printing system in accordance with other example embodiments of the invention. The ink jet printing system 100 illustrated in FIG. 3 may have a configuration similar to that of the ink jet printing system 100 illustrated in FIG. 2 except the at least one second identification member 23 proximate to an auxiliary gantry 41.

In the ink jet printing system 100 illustrated in FIG. 3, the at least one second identification member 23 may be attached to the auxiliary gantry 41. The control member 29 may enable the at least one second identification member 23 to identify the discharging points 27 of the chemical liquid in the maintenance section 13 or on the second substrate 33. When the chemical liquid is discharged in the maintenance section 13, the auxiliary gantry 41 may move toward the discharging points 27 along the second direction. Further, the second substrate 33 may be moved toward the auxiliary gantry 41 when the chemical liquid is discharged onto the second substrate 33.

In the ink jet printing system 100 illustrated in FIG. 3, the control member 29 may correct the discharging points of the chemical liquid provided onto the first substrate 31 in the printing section 11 through the identifications of the two first alignment marks 21 and the two second alignment marks 25 and the identification of the discharging points 27 of the chemical liquid on the second substrate 33. After the correction of the discharging points of the chemical liquid is accomplished, the chemical liquid may be discharged onto the first substrate 31 in the printing section 11, and thus the ink jet printing system 100 may exactly provide the chemical liquid onto the dense pixel regions of the first substrate 31 for a display device having high resolution.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. An ink jet printing system including a printing section and a maintenance section, which comprises:

at least one first alignment mark disposed in the printing section along a first direction;

an ink jet head for discharging chemical liquid onto a substrate;

at least one second alignment mark disposed in the maintenance section along a second direction perpendicular to the first direction;

at least one first identification member disposed proximate to the ink jet head, the at least one first identification member identifying the at least one first alignment mark and the at least one second alignment mark;

a gantry extended from the printing section to the maintenance section, the gantry moving the ink jet head between the printing section and the maintenance section;

at least one second identification member disposed proximate to the gantry, the at least one second identification member identifying discharging points of the chemical liquid in the maintenance section; and a control member for correcting discharging points of the chemical liquid discharged from the ink jet head onto the substrate in the printing section based on a result that the at least one second identification member identifies the discharging points in the maintenance section.

2. The ink jet printing system of claim 1, wherein the printing section is disposed in the first direction, and the maintenance section is proximate to the printing section and is disposed in the second direction.

3. The ink jet printing system of claim 1, wherein the ink jet head moves in the second direction and the gantry moves in the first direction.

4. The ink jet printing system of claim 3, wherein the at least one first identification member moves in the first direction and the second direction.

5. The ink jet printing system of claim 4, wherein the ink jet printing system includes two first identification members and two first alignment marks, and wherein the two first identification members identify the two first alignment marks as the ink jet head moves in the printing section.

6. The ink jet printing system of claim 5, wherein the ink jet printing system includes two second alignment marks, and wherein the two first identification members identify the two second alignment marks as the ink jet head moves in the maintenance section.

7. The ink jet printing system of claim 1, wherein the at least one second identification member moves in the second direction.

8. The ink jet printing system of claim 7, wherein the ink jet printing system includes two second identification members, and wherein the two first identification members identify the two second alignment marks as the gantry moves in the maintenance section.

9. The ink jet printing system of claim 1, further comprising floating stages for floating the substrate and transfer members for transferring the substrate disposed in each of the printing section and the maintenance section, respectively.

10. The ink jet printing system of claim 1, further comprising an auxiliary gantry disposed in the maintenance section along the second direction wherein the at least one second identification member is disposed proximate to the auxiliary gantry.

11. An ink jet printing system including a printing section and a maintenance section, which comprises:

at least one first alignment mark disposed in the printing section along a first direction;

an ink jet head for discharging chemical liquid onto a substrate;

at least one second alignment mark disposed in the maintenance section along a second direction perpendicular to the first direction;

at least one first identification member disposed proximate to the ink jet head, the at least one first identification member identifying the at least one first alignment mark and the at least one second alignment mark;

a gantry extended from the printing section to the maintenance section, the gantry moving the ink jet head between the printing section and the maintenance section;

at least one second identification member disposed proximate to the gantry, the at least one second identification member identifying discharging points of the chemical liquid in the maintenance section; and a control member controlling a setting of a position of the at least one first identification member for identifying the at least one first alignment mark and the at least one second alignment mark, a setting of a position of the ink jet head based on identifications of the at least one first alignment mark and the at least one second alignment mark, and a setting of a position of the at least one second identification member for identifying the discharging points of the chemical liquid.

12. The ink jet printing system of claim 11, wherein the ink jet printing system includes two first identification members and two second alignment marks, and wherein the control member enables the two first identification members to identify one of the two second alignment marks, and one of the two first identification members to identify the two second alignment marks such that the control member controls the setting of the position of the ink jet head relative to the first direction and the second direction.

13. The ink jet printing system of claim 11, wherein the control member corrects discharging points of the chemical liquid discharged from the ink jet head onto the substrate in the printing section based on a result that the at least one second identification member identifies the discharging points in the maintenance section.

14. The ink jet printing system of claim 11, wherein the ink jet printing system includes two first alignment marks provided on a first substrate transferred in the printing section along the first direction.

15. The ink jet printing system of claim 14, wherein the ink jet printing system includes two second alignment marks provided on a second substrate transferred in the printing section along the first direction.

16. The ink jet printing system of claim 15, wherein the second substrate includes a relatively short side in the first direction and a relatively long side in the second direction.

17. The ink jet printing system of claim 15, further comprising a member for preventing a spread of the chemical liquid provided on the second substrate.

18. The ink jet printing system of claim 11, further comprising an auxiliary gantry disposed in the maintenance section along the second direction wherein the at least one second identification member is disposed proximate to the auxiliary gantry.

19. An ink jet printing system including a printing section and a maintenance section, which comprises:

two first alignment marks disposed in the printing section along a first direction;

an ink jet head for discharging chemical liquid onto a substrate;

two second alignment marks disposed in the maintenance section along a second direction perpendicular to the first direction;

two first identification members disposed proximate to the ink jet head, wherein the two first identification members identify the two first alignment marks and the two second alignment marks;

a gantry extended from the printing section to the maintenance section, wherein the gantry moves along the first direction and transfers the ink jet head between the printing section and the maintenance section along the second direction;

a second identification member disposed proximate to the gantry, wherein the second identification member identifies discharging points of the chemical liquid in the maintenance section; and a control member controlling a setting of a position of the first identification members for identifying the first alignment marks and the second alignment marks, a setting of a position of the ink jet head based on identifications of the first alignment marks and the second alignment marks, and a setting of a position of the second identification member for identifying the discharging points of the chemical liquid, wherein the control member corrects discharging points of the chemical liquid discharged from the ink jet head onto the substrate in the printing section based on a result that the second identification member identifies the discharging points in the maintenance section.

20. The ink jet printing system of claim 19, further comprising an auxiliary gantry disposed in the maintenance section along the second direction wherein the second identification member is disposed proximate to the auxiliary gantry.

* * * * *